US005516557A

United States Patent [19]

Willnow et al.

[11] Patent Number: 5,516,557

[45] Date of Patent: May 14, 1996

[54] METHOD FOR APPLYING A FLOCCULATING COATING COMPOSITION INCLUDING MAINTAINING TURBULENT FLOW CONDITIONS DURING EXTRUSION

[75] Inventors: Alfred H. Willnow, Ontario; Kent J. Evans, Lima, both of N.Y.

[73] Assignee: Xerox Corporation, Stamford, Conn.

[21] Appl. No.: 368,129

[22] Filed: Jan. 3, 1995

[51] Int. Cl.[6] ..... B05D 1/26

[52] U.S. Cl. ..... 427/358; 118/410

[58] Field of Search ..... 427/356, 358; 118/410

[56] References Cited

U.S. PATENT DOCUMENTS

| | | | |
|---|---|---|---|
| 3,227,136 | 1/1966 | Bartlett et al. | 118/410 |
| 4,038,442 | 7/1977 | Utumi | 427/356 |
| 4,521,457 | 6/1985 | Russell et al. | 427/286 |
| 5,273,583 | 12/1993 | Langlois et al. | 118/665 |

*Primary Examiner*—Shrive Beck
*Assistant Examiner*—Katherine A. Bareford

[57] ABSTRACT

A process is disclosed for forming a coating from a flocculating coating composition containing pigment particles dispersed in a solution of a film forming binder dissolved in a fugitive liquid carrier, maintaining the coating composition in average shear conditions of at least about 10 reciprocal seconds while transporting the coating composition through an inlet of an extrusion die, through a manifold of the die, through an extrusion slot of the extrusion die and onto a substrate to form a coating layer on the substrate, and rapidly removing the fugitive liquid from the coating while maintaining the coating composition in the coating layer in an undisturbed condition until the coating solidifies.

12 Claims, 3 Drawing Sheets

METHOD FOR APPLYING A FLOCCULATING COATING COMPOSITION INCLUDING MAINTAINING TURBULENT FLOW CONDITIONS DURING EXTRUSION

BACKGROUND OF THE INVENTION

This invention relates to a process for applying a coating of pigment particles in a film forming binder by extrusion coating techniques.

Numerous techniques have been devised to form a layer of a coating composition on a substrate. One of these techniques involves the use of an extrusion die from which the coating composition is extruded onto the substrate. For fabrication of web type, flexible electrophotographic imaging members, the extrusion die must lay down very thin coatings meeting extremely precise, critical tolerances in the single or double digit micrometer ranges. Moreover, a plurality of dies may be needed to lay down up to three extruded coatings conventionally employed for flexible electrophotographic imaging members. The flexible electrophotographic imaging members may also comprise additional coatings applied by non-extrusion coating techniques so that the finished electrophotographic imaging member can contain as many as 5 different coatings. The extrusion die usually comprises spaced walls, each having a surface facing each other. These spaced walls form a narrow, elongated, passageway. Generally a coating composition is supplied by a reservoir through an inlet to a manifold that feeds the coating composition to one side of the passageway and the coating composition travels through the passageway to an exit slot on the side of the passageway opposite the reservoir. Dams are provided at opposite ends of the passageway to confine the coating composition within the passageway as the coating travels from the reservoir to the exit slot.

It has been observed that some organic pigment coating dispersions form extruded coatings that often exhibit visible defects such as brush mark streaks and wavy patterns, particularly at higher pigment concentrations.

Thus the characteristics of common extrusion systems exhibit processing deficiencies for manufacturing coated articles having precise tolerance and quality requirements.

INFORMATION DISCLOSURE STATEMENT

U.S. Pat. No. 5,273,583 to Langlois et al., issued Dec. 28, 1993—Apparatus for the continuous coating of charge transport solutions onto a substrate to form an electrophotographic imaging member, including a pump to a flow of a first highly doped charge transport solution and a pump to a flow of a second undoped or lowly doped charge transport solution at predetermined rates to a common junction at which the flows intermix into a common flow upon contacting each other; piping connecting the pumping means to the common junction; and mixing device associated with the junction for continuously mixing the common flow during its movement through the mixing device, the mixing device having a short spiral flow path of less than about 200 cm for the solutions sufficient to substantially complete mix the common flow during its movement through the mixing means.

U.S. Pat. No. 4,521,457 to Russell et al., issued Jun. 4, 1985—A process is disclosed wherein at least one ribbon-like stream of a first coating composition adjacent to and in edge contact with at least one second ribbon-like stream of a second coating composition are deposited on the surface of a support member by establishing relative motion between the surface of the support member and the ribbon-like streams, simultaneously constraining and forming the ribbon-like streams parallel to and closely spaced from each other, contacting adjacent edges of the ribbon-like streams prior to applying the ribbon-like streams to the surface of the support member and thereafter applying the ribbon-like streams to the surface of the support member. A thin spacing member having a thickness of less than about 100 micrometers is employed to separate the two coating compositions.

SUMMARY OF THE INVENTION

It is an object of the invention to provide a process for forming a coating from a coating composition comprising pigment particles dispersed in a solution of a film forming binder dissolved in a fugitive liquid carrier, maintaining the coating composition in a turbulent flow field under average shear conditions at least about 10 reciprocal seconds with a most preferred having a minimum average shear rate of at least about 50 reciprocal seconds while transporting the coating composition through an inlet of an extrusion die, through a manifold of the die, through an extrusion slot of the extrusion die and onto a substrate to form a coating layer on the substrate, and rapidly removing the fugitive liquid from the coating while maintaining the coating composition in the coating layer in an undisturbed condition until the coating solidifies.

This process may be employed to coat the surface of support members of various configurations including webs, sheets, plates, drums, and the like. The support member may be flexible, rigid, uncoated, precoated, as desired. The support members may comprise a single layer or be made up of multiple layers.

BRIEF DESCRIPTION OF THE DRAWINGS

A more complete understanding of the process and apparatus of the present invention can be obtained by reference to the accompanying drawings wherein.

The figures are merely schematic illustrations of the prior art and the present invention. They are not intended to indicate the relative size and dimensions of extrusion dies or components thereof.

DESCRIPTION OF THE PREFERRED EMBODIMENTS

Figure 2:
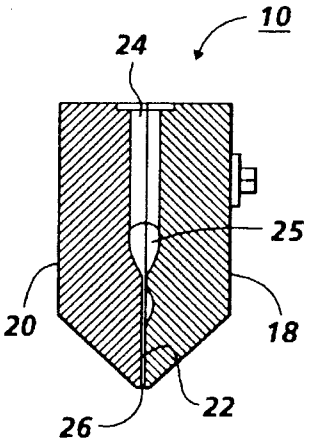
FIG. 2 PRIOR ART
FIG. 2 is a schematic, sectional end view of the extrusion die of FIG. 1 taken in the direction 2—2.
Figure 1:
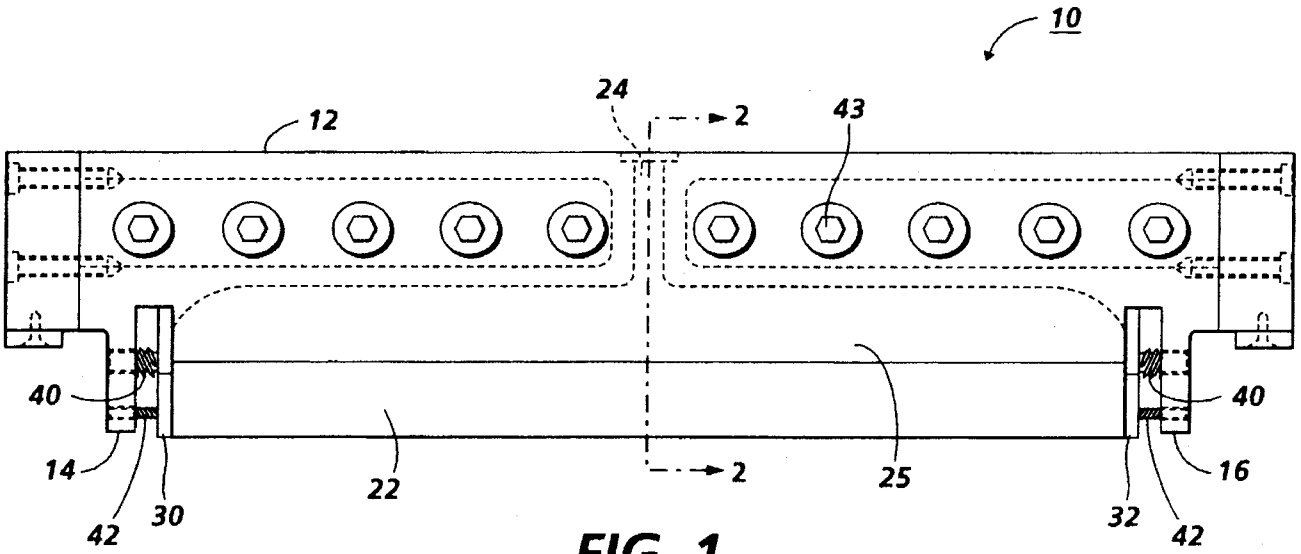
FIG. 1 PRIOR ART
FIG. 1 is a schematic, plan view showing a prior art extrusion die comprising a wide inlet channel, a wide manifold and a wide extrusion passageway.

Referring to FIGS. 1 and 2, a die assembly designated by the numeral 10 is illustrated. Extrusion dies are utilized for extrusion of coating compositions onto a support. Extrusion dies are well know and described, for example, in U.S. Pat. No. 4,521,457, the entire disclosures thereof being incorporated herein by reference. Die assembly 10 comprises a die body 12 equipped with clamping flanges 14 and 16. Die body 12 comprises and upper body 18 and lower body 20 which are spaced apart to form a flat narrow passageway 22 (see FIG. 2). Passageway 22 is fed a coating composition which enters die body 12 through inlet 24 and is transported through manifold 25 and through passageway 22 to exit slot 26 through which the coating composition is extruded as a ribbon-like stream onto a moving web substrate (not shown). The width, thickness, and the like of the ribbon-like stream can be varied in accordance with factors such as the viscosity of the coating composition, thickness of the coating desired, and width of the web substrate on which the coating composition is applied, and the like. End dams 30 and 32 (see FIG. 1) are secured to the ends of upper body 18 and lower body 20 of die body 12 to confine the coating composition within the ends of die body 12. The length of passageway 22 should be sufficiently long to also ensure laminar (or streamline) flow. Control of the distance of exit slot 26 from the substrate to be coated enables the coating composition to bridge the gap between the exit slot 26 and the moving substrate depending upon the viscosity and rate of flow of the coating composition. Clamping flanges 14 and 16 contain threaded holes into which set screws 40 and 42 are screwed to secure end dams 30 and 32 against the open ends of die body 12. Any suitable means such as screws 43, bolts, studs, or clamps (not shown) or the like, may be utilized to fasten upper lip 18 and lower lip 20 together.

Figure 4:
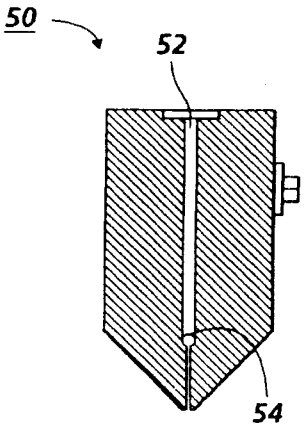
FIG. 4 is a schematic, sectional end view of the extrusion die of FIG. 3 taken in the direction 4—4.
Figure 3:
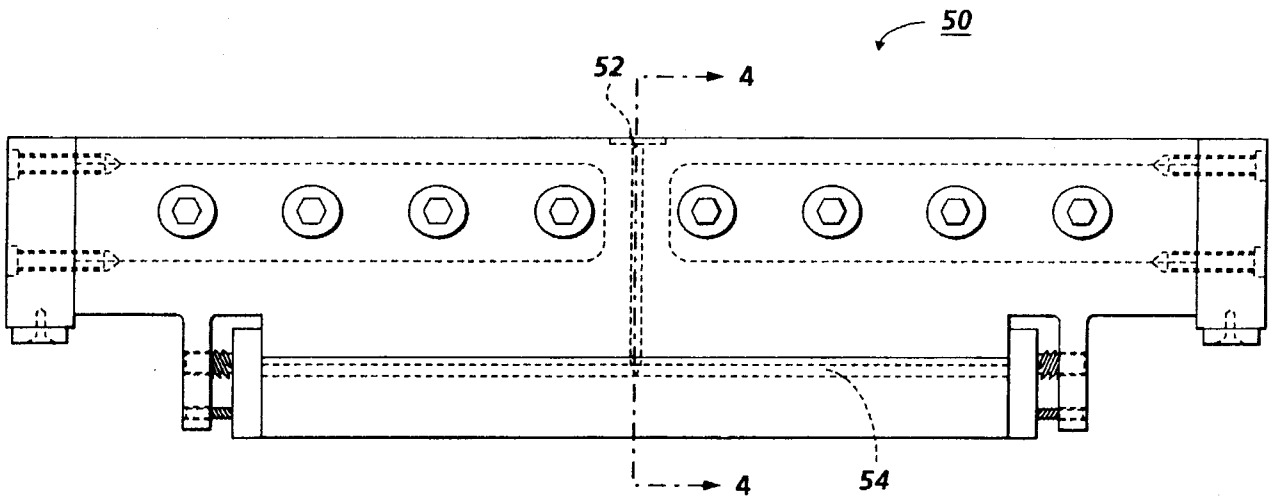
FIG. 3 is a schematic, plan view showing an extrusion die of this invention comprising a narrow inlet channel, a narrow manifold and a narrow extrusion passageway.

In FIGS. 3 and 4 a die assembly embodiment of this invention 50 is shown. It is similar in shape to the die assembly shown in FIGS. 1 and 2 except for the size and shape of the inlet 52, manifold 54 and passageway 56. The cross sectional area of the inlet 52 has been markedly reduced. Manifold 54 has a very small circular cross-sectional shape instead of the large tear drop cross-sectional shape of the manifold 25 shown in FIG. 2. Reduction of the cross-sectional area of the inlet 52 and manifold 54 also reduces the residence time of the coating material in the extrusion die. These changes prevent the flocculation of pigment particles dispersed in a liquid carrier. For example, it has been found that particles of benzimidazole perylene tends to flocculate from dispersions at low shear conditions. It should be noted, however, that some dispersed particulate materials do not regulate or flocculate at low shear conditions. An example of particulate materials that form relatively stable dispersions that do not flocculate at low shear conditions include, for example, inorganic trigonal selenium particles.

Figure 5:
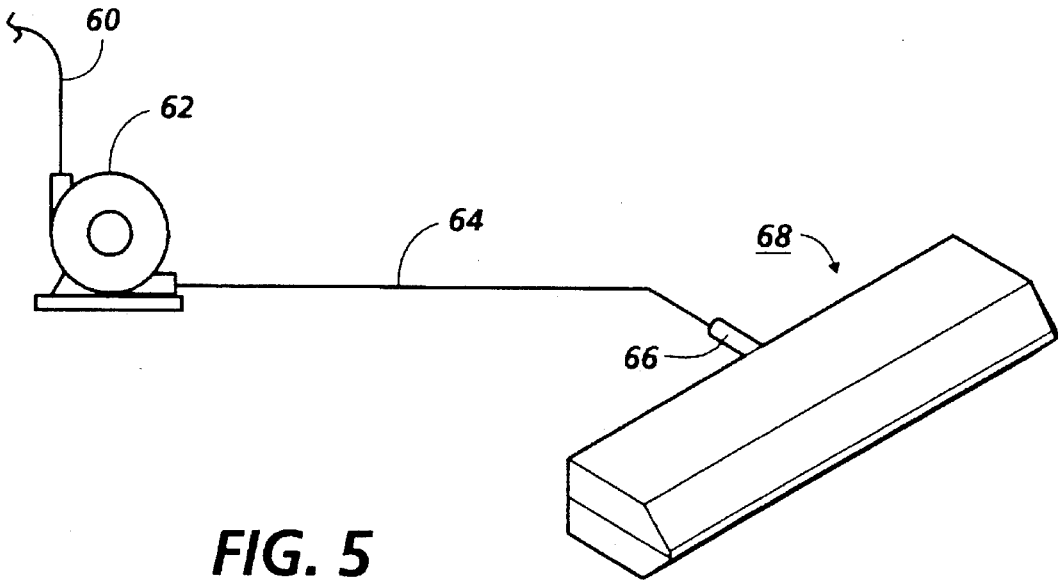
FIG. 5 PRIOR ART
FIG. 5 is a schematic, partially isometric view of a feed line connecting a pump to an extrusion nozzle.

FIG. 5 illustrates a conventional arrangement where a coating composition is supplied from a reservoir (not shown) through line 60 to a conventional pump 62 or other suitable well known means such as a gas pressure system (not shown) which feeds the coating composition under pressure through a feed line 64 to the inlet 66 of the die body 68.

Figure 6:
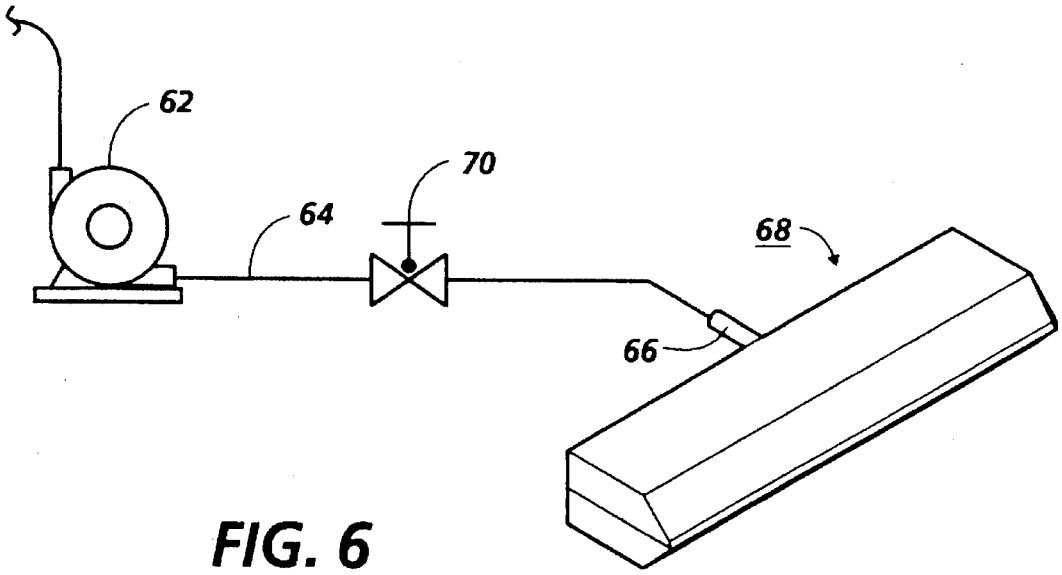
FIG. 6 is is a schematic, partially isometric view of a needle valve in a feed line connecting a pump to an extrusion nozzle.

FIG. 6 illustrates a similar arrangement except that a needle valve 70 is placed in the feed line 64 between pump 62 and inlet 66 of the die body 68. The needle valve is adjusted to obtain a pressure drop in the flowing coating composition as it passes through needle valve 70. The imposed pressure drop imparts energy to the coating compostion and further breaks-up any flocculation. Needle valve 70 is adjustable to compensate for different conditions such a change in coating composition viscosity. In general, the mixing value is operated with a pressure drop such that the shear rate in the value is greater than 100 $sec^{-1}$.

Any suitable rigid material may be utilized for the main die body. Typical rigid materials include, for example, stainless steel, chrome plated steel, ceramics, or any other metal or plastic capable of maintaining precise machining tolerances. Stainless steel and plated steel having a nickel plated intermediate coating and a chrome plated outer coating are preferred because of their long wear characteristics and capability of maintaining precise machining tolerances. The main die body may comprise separate top and bottom sections. To achieve the extremely precise coating thickness profiles and exceptional surface quality requirements desired for electrophotographic imaging member coatings, the finish grinding of the die should be accomplished consistently under high tolerance constraints across the entire die width, e.g. widths as high as 155 (60 inches).

Any suitable coating composition may be applied to a substrate with the extrusion die of this invention. Generally, the coating composition comprises pigment particles dispersed in a solution of a film forming binder dissolved in a fugitive liquid carrier. Any suitable liquid carrier may be utilized. A liquid carrier is a solvent for the film forming binder utilized in the coating mixture. The fugitive liquid carrier may be a solvent which dissolves the film forming polymer. Typical solvents or liquid carriers include, for example, methylene chloride, tetrahydrofuran, toluene, methyl ethyl ketone, isopropanol, methanol, cyclohexanone, heptane, other chlorinated solvents, water, and the like. Any suitable film forming polymer may be used. Typical film forming polymers include, for example, polycarbonates, polyesters, polyvinylbutyrals, VMCH and the like. Satisfactory results are achieved when the film forming binder is present in the final coating in an amount between about 10 and about 90 volume percent based on the total volume of the dried coating. Preferably, between about 30 percent and about 80 percent by volume of the film forming binder is present in the dried coating.

Any suitable organic pigment particles may be used in the coating composition. Typical organic pigment particles include, for example the phthalocyaninies: hydroxy-gallium, vanadyl, titanyl, X-form metal free, etc. or the perylenes such as benzimidazole perylene and the like. Whereas satisfactory results are achieved when average pigment particle size is less than about 1 micrometer. Preferably, the average pigment particle size is less than about 0.5 micrometers. Generally, the pigment concentration in the coating compositions utilized in the process of this invention is between about 20 percent and about 80 percent by volume based on the total volume of the coating composition.

When coating dispersions that flocculate at low shear rate conditions are extrusion coated onto a substrate, it has been found that the deposited coating exhibits brush mark patterns. The brush marks appear as dark streaks similar to those formed by application of a coating using a paint brush and are visible with the naked eye. These brush marks on a photoreceptor actually print out as optical density variations in the solid areas of a toner image. They are also objectionable from a cosmetic point of view. Photoreceptors containing brush marks are scrapped because they are unsuitable for forming quality images.

When flocculation occurs, clumps are formed in the shape of large chains or agglomerates of pigment particles. These clumps are present in the inlet, manifold and extrusion slot of die extrusion systems.

In the process of this invention, flocculation is avoided in the flowing mixture while it passes through the die inlet, die manifold, die slot and while it dries as a coating on coated substrate by maintaining the coating composition in a high shear flow field with and average shear rate of at least 10 reciprocal seconds with average shear rates above 50 reciprocal seconds preferred. Generally, the average shear rate at entrance to a die slot with a prior art is about 2 reciprocal seconds or less. In contrast, the typical average shear rate at the entrance to a die slot in the process of this invention is 120 reciprocal seconds. Preferably, the flow history of the dispersion utilized in the process of this invention has a shear rate at least about 50 reciprocal seconds.

A phenomenon of shear thinning occurs as the shear increases. Shear thinning, a non newtonian condition, should be maintained as the coating composition passes through the extrusion die. Shear can be measured with the aid of a rheometer. Generally, rheometers comprise a cup containing the dispersion to be measured and a rotating cylinder immersed in the dispersion. When flocculation occurs, clumps of pigment material are visible to the naked eye. The clumps have a three dimensional network structure whereas non-newtonian dispersions have a two dimensional structure. Shear thinning dispersions possess a yield point. Under the coating conditions utilized in the process of this invention, the dispersions are subjected to sufficient shear thinning to maintain the dispersion above the yield point. The size of the clumps prior to exceeding the yield point have an average size of at about 200 micrometers or greater whereas the average particle size and coating compositions maintained above the yield point have an average particle size of about 10 micrometers or less. Generally, the coating compositions utilized in the process of this invention are also subjected to a pressure drop across a mixing valve of at least 10 psi. A typical inlet channel has the cross-sectional area of less than about 0.5 millimeters. Typical inlet channel lengths range from several millimeters to many centimeters long. The residence time of the coating composition in the extrusion die can be less than about 5 seconds, and less than about 3 seconds. The pressure drop across the mixing device can be at least 20 psi.

Generally, the coating dispersion of this invention is subjected to intense shearing through the extrusion die to the point where the dispersion emerges from the extrusion nozzle. The coating formed by the extrusion process is maintained in an undisturbed condition while the solvent is removed. Because of the power law index and yield point, the particles and coatings freshly formed by the process of this invention do not associate and form agglomerates because the liquid carrier is removed before such agglomeration can occur. Thus, it is also important that the applied coating dry prior to formation of clumps. The use of a highly volatile fugitive liquid carrier facilitates avoidance of clumping.

It has also been found that even where high shear conditions are maintained along the extrusion die manifold and in the inlet channel, a "streaky/mottle" band pattern can occasionally form in the coating in the region immediately opposite the point where the inlet channel joins the die manifold. To eliminate this problem, a means to create a high pressure drop positioned between the coating dispersion supply reservoir and the inlet channel into die manifold is desirable. Any suitable means to create a high pressure drop over a short distance and an average shear rate of at least about 100 reciprocal seconds may be utilized. Typical means to create a pressure drop include, for example, needle valve and orifice plate, ball valve, jet nozzle, short capillary tube, and the like. For example, a one eighth inch needle valve operating at 10 psi accomplishes this. Needle valves are particularly preferred because they are adjustable to accommodate changes in concentration of the pigment, distance, coating mixture of viscosity and the like. Devices that create a pressure drop are also associated with high average shear rates. However, a static mixer such as employed in U.S. Pat. No. 5,273,583 does not produce an average shear rate of greater than about 20 reciprocal seconds.

The selection of the narrow die passageway and exit slot height generally depends upon factors such as the fluid viscosity, flow rate, distance to the surface of the support member, relative movement between the die and the substrate and the thickness of the coating desired. Generally, satisfactory results may be achieved with narrow passageway and exit slot heights between about 75 micrometers and about 400 micrometers. Good coating results have been achieved with slot heights between about 100 micrometers and about 200 micrometers. Optimum control of coating uniformity and edge to edge contact are achieved with slot heights between about 125 micrometers and about 150 micrometers. The roof, sides and floor of the narrow die passageway should preferably be parallel and smooth to ensure achievement of laminar flow.

The gap distance between the die outer lip surface adjacent to the exit slot and the surface of the substrate to be coated depends upon variables such as viscosity of the coating material, the velocity of the coating material and the angle of the narrow extrusion passageway relative to the surface of the support member. Generally speaking, a smaller gap is desirable for lower flow rates. Regardless of the technique employed, the flow rate and distance should be regulated to avoid splashing, dripping, puddling and doctoring of the coating material.

Relative speeds between the coating die and the surface of the substrate up to about 100 feet per minute have been tested. However, it is believed that greater relative speeds may be utilized if desired. The relative speed should be controlled in accordance with the flow velocity of the ribbon-like stream of coating material.

The flow velocities or flow rate per unit width of the narrow die passageway for the ribbon-like stream of coating material should be sufficient to fill the die to prevent dribbling and to bridge the gap as a continuous stream moves to the surface of the substrate. However, the flow velocity should not exceed the point where non-uniform coating thicknesses are obtained due to splashing or puddling of the coating composition. Varying the die to substrate surface distance and the relative die to support member surface speed will help compensate for high or low coating composition flow velocities.

The coating technique of this invention can accommodate an unexpectedly wide range of coating compositions viscosities from viscosities comparable to that of water to viscosities of molten waxes and molten thermoplastic resins. Generally, lower coating composition viscosities tend to form thinner wet coatings whereas coating compositions having high viscosities tend to form thicker wet coatings. Obviously, wet coating thickness will form thin dry coatings when the coating compositions employed are in the form of solutions, dispersions or emulsions.

The pressures utilized to extrude the coating compositions through the narrow die passageway depends upon the size of the passageway and viscosity of the coating composition.

Any suitable temperature may be employed in the coating deposition process. Generally, ambient temperatures are preferred for deposition of solution coatings. However, higher temperatures may be necessary for depositing coatings such as hot melt coatings.

A number of examples are set forth herein below and are illustrative of different compositions and conditions that can be utilized in practicing the invention. All proportions are by weight unless otherwise specified. It will be apparent, however, that the invention can be practiced with many types of compositions and can have many different uses in accordance with the disclosure above and as pointed out hereinafter.

EXAMPLE I

A coating composition was prepared containing about 280 grams of an organic photoconductive perylene pigment having a particle size of about 0.2 micrometer, about 320 grams of polycarbonate binder resin, and about 9400 grams of a volatile solvent. This composition had a viscosity of about 105 cp and was applied by means of an extrusion die (similar to the die illustrated in FIGS. 1 and 2) to a metalized polyethylene terephthalate film coated with a polyester coating.

The extrusion die design incorporated an inlet diameter of 0.5 inch (12.7 millimeters), a manifold diameter of 0.71 inch (18 millimeters), and passageway height of 0.005 inch (0.127 millimeters). The geometric average shear rate was 2 $sec^{-1}$ or less, the residency time of the coating composition was approximately 16 seconds and the flow rate of 200 cc/min in the extrusion die.

The film was transported beneath the die assembly at about 21 meters per minute. The length, width, and height of the narrow extrusion passageway in the die was about 28 mm, 410 mm, and 0.127 millimeters respectively. The deposited coating was dried in a multizone dryer with a maximum temperature of 143° C. The deposited dried coating exhibited a visible non-uniform mottle pattern resembling brush marks as well as streaks and dark spots.

EXAMPLE II

The procedures described in Example I were repeated except that a different die design was employed (similar to the die illustrated in FIGS. 3 and 4).

The extrusion die design incorporated an inlet diameter of 0.19 inch, a manifold diameter of 0.1875 inch (4.8 millimeters), and passageway height of 005 inch (0.127 millimeters). The geometric average shear rate at the inlet to the manifold was 100 $sec^{-1}$ or higher, the residency time of the coating composition was 2.6 seconds and the flow rate was 200 cc/min in the extrusion die.

The film was transported beneath the die assembly at about 21 meters per minute. The length, width, and height of the narrow extrusion passageway in the die was about 28 mm, 410 mm, and 0.127 millimeters respectively. The deposited coating was dried in a multizone dryer at a maximum temperature of 143° C. The deposited dried coating exhibited no visible brush marks, streaks or dark spots except at the center of the coating opposite the die inlet. At the center of the coating, a "streaky/mottle band, 5–10 cm wide was observed. This defect was resolved as in example III.

EXAMPLE III

The procedures described in Example II were repeated except that a needle valve was installed in the feed line at the inlet of the die. The needle valve was adjusted to achieve a pressure drop across the valve of 10 psig. The deposited dried coating exhibited neither visible brush marks, streaks or dark spots, nor a "streaky/mottle band immediately opposite the inlet to the die.

EXAMPLE IV

The procedures described in example 1 where repeated with a coating composition containing about 236 grams of an organic photoconductive pthalocyanine pigment having a particle size of about 0.2 micrometers, about 266 grams of polycarbonate binder resin, and about 9911 grams of a volatile solvent. This composition had a viscosity of about 12 cp and was applied by means of an extrusion die (similar to the die illustrated in FIGS. 1 and 2) to a metalized polyethylene terephthalate film coated with a polyester coating.

The extrusion die design incorporated an inlet diameter of 0.5 inch (12.7 millimeters), a manifold diameter of 0.71 inch (18 millimeters), and passageway height of 0.005 inch (0.127 millimeters). The geometric average shear rate was 2 $sec^{-1}$ or less, the residency time of the coating composition was approximately 16 seconds and the flow rate of 200 cc/min in the extrusion die.

The film was transported beneath the die assembly at about 21 meters per minute. The length, width, and height of the narrow extrusion passageway in the die was about 28 mm, 410 mm, and 0.127 millimeters respectively. The deposited coating was dried in a multizone dryer with a maximum temperature of 143° C. The deposited dried coating exhibited a visible non-uniform mottle pattern resembling brush marks as well as streaks and dark spots.

EXAMPLE V

The procedures described in Example IV were repeated except that the die design from Example II was employed (similar to the die illustrated in FIGS. 3 and 4).

The film was transported beneath the die assembly at about 21 meters per minute. The length, width, and height of the narrow extrusion passageway in the die was about 28 mm, 410 mm, and 0.127 millimeters respectively. The deposited coating was dried in a multizone dryer at a maximum temperature of 143° C. The deposited dried coating exhibited no visible brush marks, streaks or dark spots except at the center of the coating opposite the die inlet. At the center of the coating, a "streaky/mottle band, 5–10 cm wide was observed. This defect was resolved as in Example III.

EXAMPLE VI

The procedures described in Example V were repeated except that a needle valve was installed in the feed line at the inlet of the die. The needle valve was adjusted to achieve a pressure drop across the valve of 10 psig. The deposited dried coating exhibited no neither visible brush marks, streaks or dark spots, nor a "streaky/mottle" band immediately opposite the inlet to the die.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for forming a coating from a flocculating coating composition for an electrophotographic imaging member comprising organic pigment particles dispersed in a solution of a film forming binder dissolved in a fugitive liquid carrier, transporting said coating composition from a pump through a mixing device, through an inlet of an extrusion die, through a manifold of said die, through an extrusion slot of said extrusion die and onto a substrate, subjecting said coating composition to a pressure drop of at least 10 psi across said mixing device immediately prior to transporting said coating composition through said inlet of said extrusion die, maintaining said coating composition in turbulent flow under shear conditions having an average value of at least about 10 reciprocal seconds while transporting said coating composition through said inlet of an extrusion die, through said manifold of said die, through said extrusion slot of said extrusion die and onto said substrate to form a coating layer on said substrate, maintaining the residence time of said coating composition in said extrusion die to less than about 5 seconds, and removing said fugitive liquid from said coating prior to agglomeration of said organic pigment particles while maintaining said coating composition in said coating layer in an undisturbed condition until said coating solidifies.

2. A process according to claim 1 including subjecting said coating composition to average shear conditions of at least about 50 $sec^{-1}$ while transporting said coating composition through said extrusion die.

3. A process according to claim 1 including maintaining the residence time of said coating composition in said extrusion die to less than about 3 seconds.

4. A process according to claim 1 including subjecting said coating composition to a pressure drop of at least 20 psi across said mixing device immediately prior to transporting said coating composition through said inlet of said extrusion die.

5. A process according to claim 4 including creating said pressure drop by passing said coating composition through a needle valve mixing device.

6. A process according to claim 4 including creating said pressure drop by passing said coating composition through an orifice.

7. A process according to claim 4 including creating said pressure drop by passing said coating composition through a jet nozzle.

8. A process according to claim 4 including creating said pressure drop by passing said coating composition through a capillary tube.

9. A process according to claim 1 wherein said manifold of said extrusion die has a circular cross sectional shape.

10. A process according to claim 1 wherein the concentration of said organic pigment particles in said coating composition is between about 20 percent and about 80 percent by volume based on the total volume of said coating composition after removal of said fugitive liquid.

11. A process according to claim 10 wherein said organic pigment particles are selected from the group consisting of hydroxy gallium phthalocyanine, vanadyl phthalocyanine, titanyl phthalocyanine, X-form metal free phthalocyanine and benzimidazole perylene.

12. A process according to claim 1 wherein said organic pigment particles have an average particle size of less than about 1 micrometer during transporting of said coating composition through said inlet, through said manifold, through said extrusion slot and onto said substrate to form said coating layer.

* * * * *